United States Patent [19]

Kistner et al.

[11] 4,030,394

[45] June 21, 1977

[54] DEVICE FOR CUTTING THROUGH A PILE OF SHEETS WITH A REVOLVING BLADE

[75] Inventors: Hermann Kistner, Tamm; Gunthart Lehmann, Heubach, Lautern, both of Germany

[73] Assignee: Maschinenbau Oppenweiler GmbH, Oppenweiler, Germany

[22] Filed: Aug. 16, 1976

[21] Appl. No.: 714,503

[30] Foreign Application Priority Data

Aug. 16, 1975 Germany ..... 2536558

[52] U.S. Cl. ..... 83/409; 83/422; 83/434; 83/435.1; 83/456; 83/508; 83/925 A; 83/734

[51] Int. Cl.[2] ..... B26D 7/06

[58] Field of Search ..... 83/422, 435.1, 437, 83/409, 434, 734, 425, 426, 431, 453, 452, 508, 925 A

[56] References Cited

UNITED STATES PATENTS

| | | | |
|---|---|---|---|
| 2,822,003 | 2/1958 | McCahon et al. | 83/422 |
| 3,460,419 | 8/1969 | Branick | 83/434 |
| 3,570,344 | 3/1971 | Bryson et al. | 83/422 |

*Primary Examiner*—Donald R. Schran
*Attorney, Agent, or Firm*—Wigman & Cohen

[57] ABSTRACT

Apparatus for cutting through a pile of sheets with a revolving blade is disclosed. The apparatus comprises a relatively slowly rotatable disk-knife having a circular cutting edge and reciprocable between a cutting position and a rest position. A conveying system is provided for holding and supplying the pile of sheets to the disk-knife and carries, on a sliding carriage, a counter-knife for the disk-knife and a pair of confronting clamping members for releasably clamping the pile of sheets during the cutting operation. A common drive is provided which is synchronously interconnected with the conveying and cutting elements of the apparatus.

15 Claims, 5 Drawing Figures

DEVICE FOR CUTTING THROUGH A PILE OF SHEETS WITH A REVOLVING BLADE

BACKGROUND OF THE INVENTION

This invention relates to apparatus for the cutting through of a pile of sheets with a disk-knife or revolving blade, the circumference of which forms a smooth circular cutting edge and to a conveying apparatus which feeds the pile of sheets to the revolving blade and clamps the pile of sheets between the confronting surfaces of two conveyor elements.

In the description which follows, the term "pile of sheets" shall mean any pile or set of sheets or folios which lie on top of each other, for example, a book, a sheet folded several times, a brochure, a booklet, a signature and the like. A "brochure" or "booklet", as used herein, is defined as a pile of sheets consisting of sheets placed on top of each other all of which are folded around a common fold forming the back of the brochure or booklet. The folios or sheets forming the brochure or booklet can be stapled or glued together at the back, however, they may also be joined loosely together. Such a brochure or booklet may be called a "signature". The term "cutting through a pile of sheets" shall, as used herein, also include the so-called "trimming" in which the edges of a pile of sheets, for example, the edges of a brochure are trimmed since, even when only its edges are trimmed, the entire pile of sheets must be cut through.

In the prior art, it is known, for example, to trim brochures at their edges or to cut them in the middle with the use of disk-knives arranged at the delivery end of folding machines. In the case of the known devices, a cylindrical counter-knife is associated with each disk-knife. The disk-knife for cutting through of the booklet has a circumferential cutting edge having a cross-section forming an acute angle and the side of which facing the counter-knife is planar. The counter-knife is formed by a circumferential edge, substantially right-angled in cross-section, of a cylinder which, together with a second cylinder concentric to the axis of the disk-knife, forms a clamping-slit for the brochure. Within increasing thickness of the brochure, the point at which the disk-knife begins its cut is shifted farther and farther away from the clamping-slit in a direction opposite to that in which the booklet advances so that the disk-knife must penetrate into the brochure at a point where it is neither supported by the counter-knife nor clamped in the clamping-slit. The consequence is that at the point of penetration of the disk-knife, the individual sheets of the brochure are not secured against displacement relative to each other. Thus, as the disk-knife penetrates into the booklet, the position of the sheets is distorted and the cut necessarily becomes more and more irregular with increasing thickness of the brochure.

In the case of folding machines, a somewhat irregular cut has little significance because the brochures or booklets are usually units or sections of books which, after having been bound, are again trimmed by means of a guillotine knife.

A device of the aforementioned type is described, for example, in Swiss Pat. No. 383,331 wherein there is disclosed that, with these known devices, when greater feeding speeds are applied, i.e., a higher cutting power is achieved, excessive heat develops at the cutting edge so that if the blade edge is not made of hard metal, it will anneal and lose its hardness. The use of hard metal blades is, however, not feasible because of the high manufacturing costs for such blades. In Swiss Pat. No. 389,574, there is disclosed a cutting device for blocks of books and mentioned therein is a revolving blade of the type used in meat slicing machines for the cutting of, for example, cold cuts and ham. This patentee states that such a revolving blade cannot be used as a cutting knife for blocks of books because the blade, when cutting through paper, wears out rapidly and must be frequently reground.

In view of the aforesaid reasons set forth in these prior art patents, heretofore, only disk-type milling cutters have been used for the cutting of the backs of books. Such cutters are actually most suitable for the cutting of backs of books where a rough-cutting surface is desired for the subsequent gluing together of the individual sheets of the book. These known cutting devices are not, however, suitable for cutting of the upper and lower edges of a booklet and the edge opposite the back of a booklet because a smooth cut surface is desired on these edges since they remain visible.

SUMMARY AND OBJECTS OF THE INVENTION

The present invention is directed to providing an apparatus for the cutting through of a pile of sheets with a disk-knife by means of which a proper and smooth cut surface is obtained on the visible edges of the sheets.

This object is accomplished according to the present invention by providing a sliding carriage movable back and forth past the axis of rotation of the disk-knife in an advance stroke from a receiving end to a take-off end and a return stroke to the receiving end. As a conveying device, the sliding carriage carries a clamping member and a counter-knife forming a counter-cutting edge for the cutting edge of the disk-knife and extending over the entire cutting range of the disk-knife. The counter-cutting edge of the counter-knife is arranged at a radial distance from the axis of rotation of the disk-knife such that the cutting edges thereof overlap only to such extent as is necessary to place the two knives adjacent one another. The radius of the disk-knife is such that, in the case of the thickest pile of sheets to be cut, the tangent line of the cutting edge of the disk-knife at its point of intersection with the facing side of the pile of sheets forms an angle with the horizontal of less than 30°. In order to achieve a draw shearing cut, the peripheral speed of the disk-knife is adjusted with respect to the speed of the advance stroke of the sliding carriage and is slightly greater than the latter.

By means of the counter-cutting edge of the counter-knife extending over the entire cutting range of the disk-knife, there is advantageously realized during the cutting process, proper support for the edge of the surface of the cut of the pile of sheets on the side opposite the disk-knife so that a precise shearing cut is possible. Because the two cutting edges overlap only to the minimum extent necessary to place the two knives adjacent one another, it is possible that, without having to oversize the disk-knife, its radius can be chosen such that, in the case of the thickest pile of sheets to be cut, the tangent line of the cutting edge of the disk-knife at its point of intersection with the facing side of the pile forms an angle with the horizontal with less than +°. Thus, there is guaranteed that the disk-knife, together with the counter-knife, form a pair of shears. Moreover, in view of the fact that the peripheral speed of the disk-knife is only slightly greater than the advance speed of the sliding carriage during the cutting process, an easy draw cut is obtained.

Another advantage of the slow revolving speed of the disk-knife resides in the fact that the cutting edge of the disk-knife is less susceptible to wear and is heated to a much lesser extent than in the case of known cutting devices with revolving blades or milling cutters. In the case of the known apparatus using revolving blades or milling cutters for the cutting of the back of a book, such blades and cutters are driven directly by a motor at about 3,000 rpm as described in Swiss Pat. No. 389,574. This high rotational speed results in a peripheral speed of the blades or cutters which is about sixty times that of the advance speed of the books to be cut. However, in accordance with the present invention, the peripheral speed of the disk-knife is only slightly higher than the advance speed of the pile of sheets to be cut in order to insure that a draw cut is achieved along all points of the cutting edge. Advantageously the peripheral speed of the disk-knife is higher only by a few percent than the advance speed of the pile of sheets.

With these and other objects, advantages and features of the invention that may become hereinafter apparent, the nature of the invention may be more clearly understood by reference to the following detailed description of the invention, the appended claims and to the several views illustrated in a schematically simplified manner in the attached drawings.

DETAILED DESCRIPTION OF A PREFERRED EMBODIMENT

Figure 1:
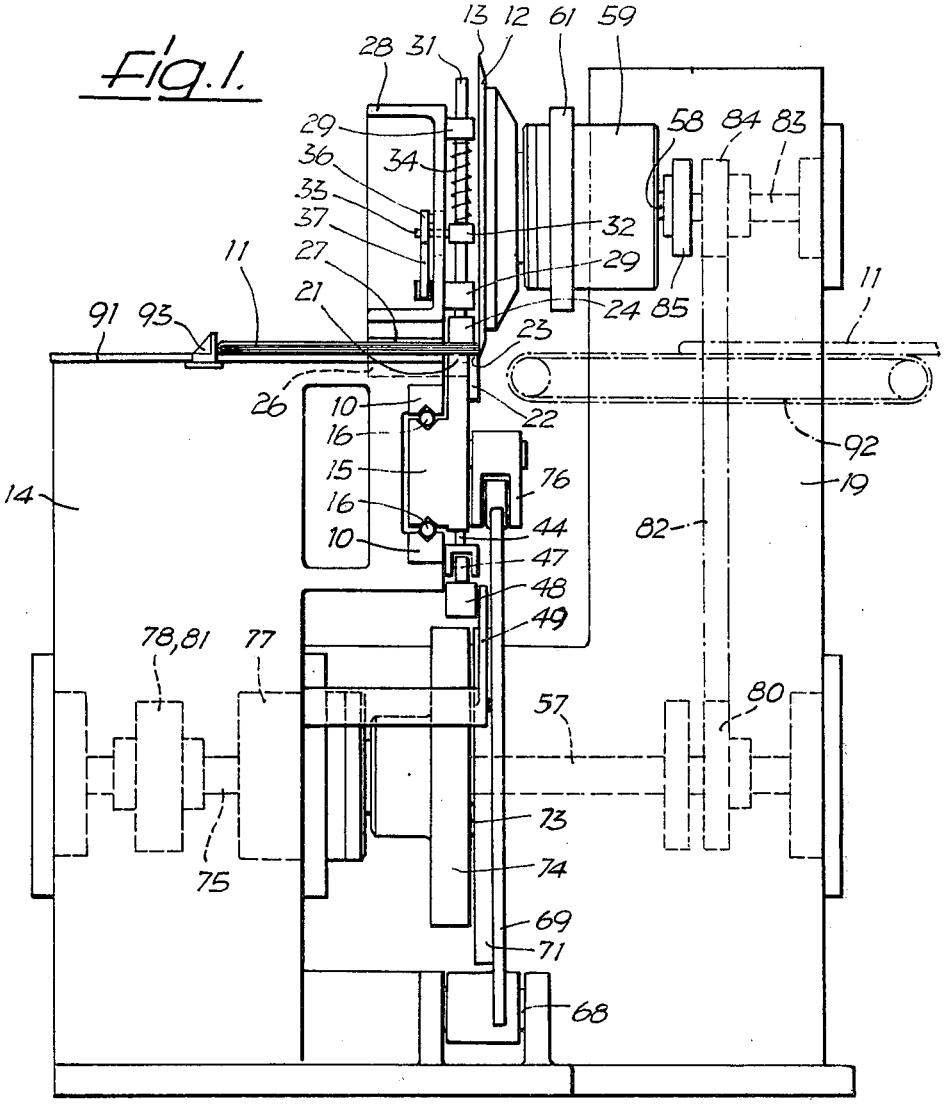
FIG. 1 is an end view of an embodiment of the invention viewed in the direction of the advance stroke of the sliding carriage.
Figure 2:
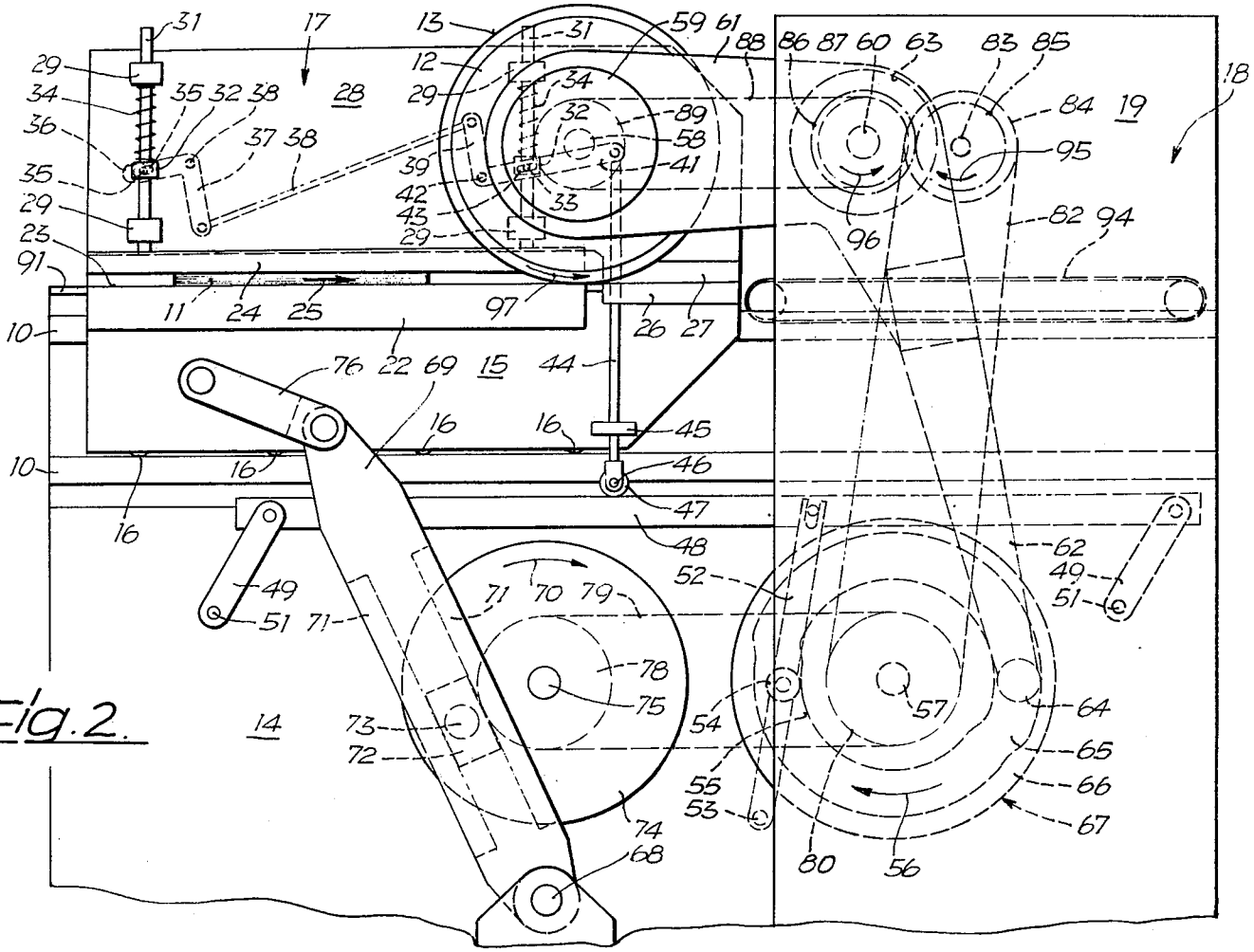
FIG. 2 is a side view from the right of the embodiment of the invention shown in FIG. 1.

Referring now to the drawings, and more particularly to FIGS. 1 and 2, the apparatus for the cutting through of a pile of sheets 11 comprises a revolving blade or disk-knife 12, the circumference of which forms a smooth, annular cutting edge 13. The apparatus includes a machine casing 14 in which a sliding carriage 15 is mounted on ball-bearings 16 disposed between rails 10 and is slidably movable in the horizontal direction. By means of an advance stroke, the sliding carriage 15 serves to transport a pile of sheets from the receiving end 17, as shown in FIG. 2 on the left thereof, through the cutting range of the disk-knife 12 and into the take-off end 18, as shown in FIG. 2 on the right thereof. The take-off end 18 is covered in FIG. 2 by a box-like projection 19 of the machine casing in which the bearing and the drive of the disk-knife 12 are incorporated.

The sliding carriage 15 is provided on its upper side with a lower clamping strip 21 serving as a clamping member and extending substantially across the entire length of the sliding carriage 15. This narrow clamping strip 21 is arranged adjacent the edge of the pile 11 to be cut. At the vertical side of the clamping strip 21 confronting the disk-knife 12, a counter-knife 22 for the disk-knife 12 is secured, the cutting edge 23 of which overlaps with the cutting edge 13 of the disk-knife 12 by a minimum degree and only to the extent necessary to place the two knives 12 and 22 adjacent each other. The horizontal upper side of the counter-blade 22 is aligned to the upper side of the clamping strip 21 and, in this manner, also forms a supporting surface for the edge of the pile 11 to be cut.

An upper clamping strip 24, serving as an upper clamping member, is mounted on the sliding carriage 15 and interacts with the clamping strip 21. Clamping strip 24 can be moved back and forth from the clamping position shown in FIG. 1 where it urges the edge of the pile 11 to be cut against the lower clamping strip 21 to a lifted-up release position not illustrated in the drawings. For the support of the upper clamping strip 24, the front end of the sliding carriage 15 as seen in the direction of the advance stroke shown in FIG. 2 by the arrow 25, has a horizontal flange 26 to which a further horizontal flange 27 at the front end of a U-shaped plate 28 is rigidly connected, the plate 28 being provided with guides 29 for two vertical rods 31 the lower ends of which are connected to the movable upper clamping strip 24. Each of the rods 31 is guided in a pair of guides 29 arranged near the ends of each rod 31. Between each pair of guides 29, rods 31 are provided with sockets 32 each having a horizontally projecting pin 33. Between the sockets 32 and the upper guide 29 of each guide pair, a spiral spring 34 surrounds the rod 31 and is arranged to rest with its upper end on the guide 29 and lower end over the socket 32 to urge the rod 31 and the corresponding end of the clamping strip 24 downwardly, i.e., on the edge of the pile 11 to be cut.

To lift the rod 31 on the left, as seen in FIG. 2, the pin 33 engages in an oblong hole 35 of one arm 36 of a toggle lever 36, 37 which is pivoted about a horizontal axle 38 attached to the plate 28 and the second arm 37 of which is connected in an articulated manner with one end of a shaft 38'. The other end of shaft 38' engages in one arm 39 of a toggle lever 39, 41 which is pivoted about an axle 42 parallel to the axle 38 and the second arm 41 of which is provided with an oblong hole 43 for the pin 33 of the socket 32 of rod 31 arranged on the right as seen in FIG. 2.

The free end of the arm 41 projects beyond the oblong hole 43 and is connected in an articulated manner at its end with the upper end of a vertical shaft 44 which is guided near its lower end in a slightly swiveling and axially movable manner in a guide 45 attached to the sliding carriage 15. The shaft 44 is provided at its lower end with a roller 47 pivoted about an axle 46 arranged vertically to the plane of the drawing of FIG. 2. By means of the roller 47, the shaft 44 is supported against the bias of springs 34 on a lifting bar 48. The lifting bar 48 is pivoted in a parallelogram-like linkage with the free ends of two parallel arms 49, the other ends of which are pivoted with respect to the machine casing 14 about axles 51 also arranged vertically to the plane of the drawing of FIG. 2. For the raising and lowering of the lifting bar 48, the upper fork-like open end of a cam lever 52 engages with lifting bar 48 and its other end is pivoted about an axle 53 also vertical to the plane of the drawing of FIG. 2. Rotatably supported between the ends of cam lever 52 is a feeler roll 54 which bears against a cam plate 55 secured to a shaft 57 which is adapted to be driven in the direction of the arrow 56. Upon rotation of the shaft 57, the cam lever 52 is pivoted back and forth about its axle 53 and urges the lifting bar 48 in an up and down movement which is transmitted to the shaft 44, the linkages 41, 39, 38, 37 and 36 to the two rods 31 and thus to the upper clamping strip 24.

The disk-knife 12 which is delimited in FIG. 1 on its left side by a plane containing the cutting edge 13, is attached to a shaft 58 rotatably mounted in a bearing 59, which bearing is attached to the free end of arm 61 of a rocker arm 61, 62. Rocker 61, 62 is pivotable about and axially movable along a shaft 60 rotatably mounted at its ends in the projection 19 by means of a free-from-play, adjustable bearing 63. The other arm 62 of the rocker arm 61, 62 supports, at its free end, a feeler roll 64 which is forceably guided in a revolving groove 65 which is delimited on the inside by the cam plate 55 and on the outside by a cam jacket 66, the whole assembly being identified by reference numeral 67 and defined as a cam element attached to the shaft 57. When the cam element 67 is rotated, the rocker arm 61, 62 is pivoted back and forth in time correlation to the back and forth movement of the upper clamping strip 24 and to the movement of the disk-knife 12 from its cutting position shown in FIGS. 1 and 2 in which it overlaps with the counter-knife, into a lifted-up or rest position which is not illustrated in the drawings.

For the advance stroke movement of the sliding carriage 15 from the receiving end 17 to the take-off end 18 and the return stroke movement, there is provided a sliding pin drive 69 pivoted about an axle 68 in the machine casing 14 and which has two parallel cam grooves 71 between which a sliding block 72 is guided. Engaged in a center borehole of block 72 is a crank pin 73, vertically arranged to the plane of the drawing of FIG. 2, of a crank disk 74 which is attached to a shaft 75 rotatably mounted in the machine casing and which is driven in the direction of arrow 70. The free end of the pin drive 69 is connected in an articulated manner with the sliding carriage 15 by means of a butt joint 76. The joint 76 serves as a compensatory joint so that, during the rotation of the shaft 75, the pin drive 69 moves back and forth to thus move the sliding carriage 15 with a slowed-down advance stroke from the receiving end 17 to the take-off end 18 and with an accelerated return stroke from the take-off end 18 back to the receiving end 17.

The shaft 75 is driven by a motor 77 and is provided with a belt pulley 78 which is connected by means of a toothed belt 79 with a belt pulley 81 mounted to the shaft 57. A second belt pulley 80 is mounted to shaft 57 and is connected by a toothed belt 82 with a belt pulley 84 pivoted on a shaft 83. Adjacent the belt pulley 84, a gear wheel 85 is mounted to the shaft 83 which engages a gear wheel 86 mounted on shaft 60. Also on shaft 60, behind gear wheel 86, there is mounted a belt pulley 87 connected via a toothed belt 88 with a belt pulley 89 mounted to shaft 58. In this manner, all movements of the described apparatus are capable of being actuated by a single motor via the toothed belt 79, 82 and 88, the crank assembly 69, 73, 74 and the cam drive 54, 55, 64 and 66.

Figure 3:
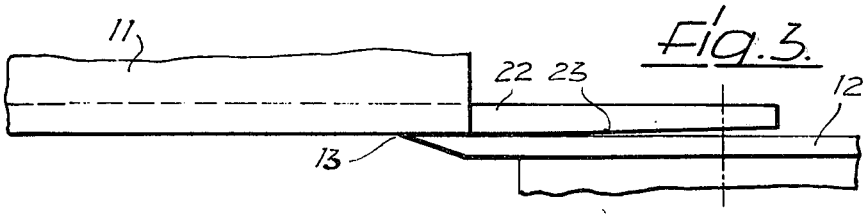
FIG. 3 is a top broken view showing the interaction of the counter-knife with the disk-knife.

The drive of the back and forth movement of the sliding carriage 15 and the disk-knife 12 is synchronized in such a manner that the disk-knife is lowered into its cutting position when the sliding carriage 15 is at the receiving end 17 and is lifted from its cutting position into its rest position when the sliding carriage 15 is at the take-off end 18. To avoid any interference or collision between the cutting edge 13 of the disk-knife 12 with the counter-knife 22 when the disk-knife 12 is lowered, the front portion of the counter-knife 22, as seen in the direction of the advance stroke 25, extends toward the front such that it remains in overlapping relation with the cutting edge 13 of the disk-knife 12 when the sliding carriage has reached its final position at the take-off end 17, i.e., after the return stroke and at the beginning of the advance stroke. At this overlapping point of both cutting edges, the cutting edge 23 of the counter-knife 22 is spaced a distance from the cutting edge 13 of the disk-knife 12 by a constant curvature of the counter-knife 22 so that the disk-knife 12 can be safely lowered into its cutting position without interference from the counter-knife 22 while the sliding carriage is in this position. When the sliding carriage 15 moves along its advance stroke, the cutting edge 23 of the counter-knife 22 approaches the disk-knife slowly and continuously until it touches the same whereby the contact occurs when the intended cutting range of the counter-knife is reached. This course of movement of the cutting edge 23 of the counter-knife 22 is illustrated schematically in the simplified and enlarged showing of FIG. 3.

As can be seen in FIG. 1, the pile 11 to be cut is only clamped near the edge which is to be cut by the clamping strips 21 and 24 of the sliding carriage 15. The remaining portion of the pile of sheets 11 rests on a table 91 of the machine casing 14. The supply of a new pile 11 to be cut into the receiving end 17 of the apparatus is accomplished by means of a conveyor belt 92, shown schematically, which ejects the pile to be cut, for example, a brochure, onto the table 91 with the back of the brochure forwardly until it touches a stop 93. For the removal of the cut pile 11 from the take-off end 18, the table is provided with a continuously running conveyor belt 94 behind the disk-knife 12 as seen in the direction of the advance stroke 25 so that the pile, as soon as it is released by the clamping strip 24, is removed from the take-off end 18 by the conveyor belt 94 for further processing.

During operation, the motor 77 runs continuously whereby the shafts 75, 57, 83, 60 and 58 revolve in the direction of the arrows 70 or 56, 95, 96, and 97, respectively, as shown in the drawings. The rotational speeds are determined in such a manner that the peripheral speed of the cutting edge 13 of the disk-knife 12 is only slightly greater than the highest advance speed of the sliding carriage 15. When determining this peripheral speed of the cutting edge 13, it is essential that the cutting edge 13 has, at no time during the cutting cyle, a horizontal component in the direction of the advance stroke which is lower than the advance stroke speed of the sliding carriage 15. In order to achieve a draw cut, the peripheral speed of the cutting edge 13 can be slightly higher, but it should not exceed the advance speed of the sliding carriage 15 by more than five times in order to avoid heating up of the disk-knife.

By means of the crank assembly 69, 73, 74, the sliding carriage is moved in adjusted time phase along the advance stroke from its position in the receiving end 17 to the take-off end 18 with an accelerated return stroke back to the receiving end 17. At the same time, the disk-knife 12 is lowered from its rest position into its cutting position by means of the cam drive 54, 55 and 64, 66 when the sliding carriage 15 has just reached its position in the receiving end and the upper clamping strip 24 is lowered from its release position into its clamping position for clamping a pile 11, introduced into the receiving end, near the pile edge which is to be cut. The supply of the pile of sheets is, in this instance, also effected in a sequence adjusted in time so that a new pile is always supplied to the receiving end when the sliding carriage 15 is in the receiving end position. During the advance stroke of the sliding carriage, the edge of the pile of sheets 11 is then cut, the edge being clamped down next to the cut by means of the two clamping strips 21 and 24 with the force of the springs 34 and the edge directly adjacent the cutting plane being supported from below along its entire length by the counter-knife 22. When the pile is moved through the cutting range of the disk-knife, the edge of the disk-knife moves only slightly faster than the pile 11 clamped in the sliding carriage 15 to thus achieve a proper shearing draw cut which, owing to the comparatively slow turning of the disk-knife 12 does not result in heating up of the disk-knife.

As soon as the pile of sheets 11 has passed the cutting range of the disk-knife 12, but prior to having reached the take-off end, the upper clamping strip 24 is lifted into its release position by the cam drive 54, 55 so that the pile of sheets 11 is seized by the conveyor belt 94, moved out of the receiving end and removed for further processing. Simultaneously with the lifting of the upper clamping strip 24, the disk-knife 12 is also lifted into its rest position to avoid any unnecessary wear of the cutting edges 13 and 23 during the accelerated return stroke. As soon as the sliding carriage 15 has again reached the receiving end 17, the above-described process is repeated for the cutting of the next pile of sheets 11.

In order to properly locate the two knives 12 and 22 adjacent one another, the rocker arm 61, 62 is, as previously mentioned, supported by its bearing 59 in an axially adjustable and flexible manner in a known way. In order to further insure that a proper shearing draw cut is produced by the disk-knife, the radius of the disk-knife 12 is of such a size that, in the case of the thickest pile 11 to be cut, the tangent line of the cutting edge of the disk-knife at its point of intersection with the side of the pile facing the disk-knife, i.e., the upper side of the pile, an angle with the horizontal of less than 30 degrees.

Figure 4:
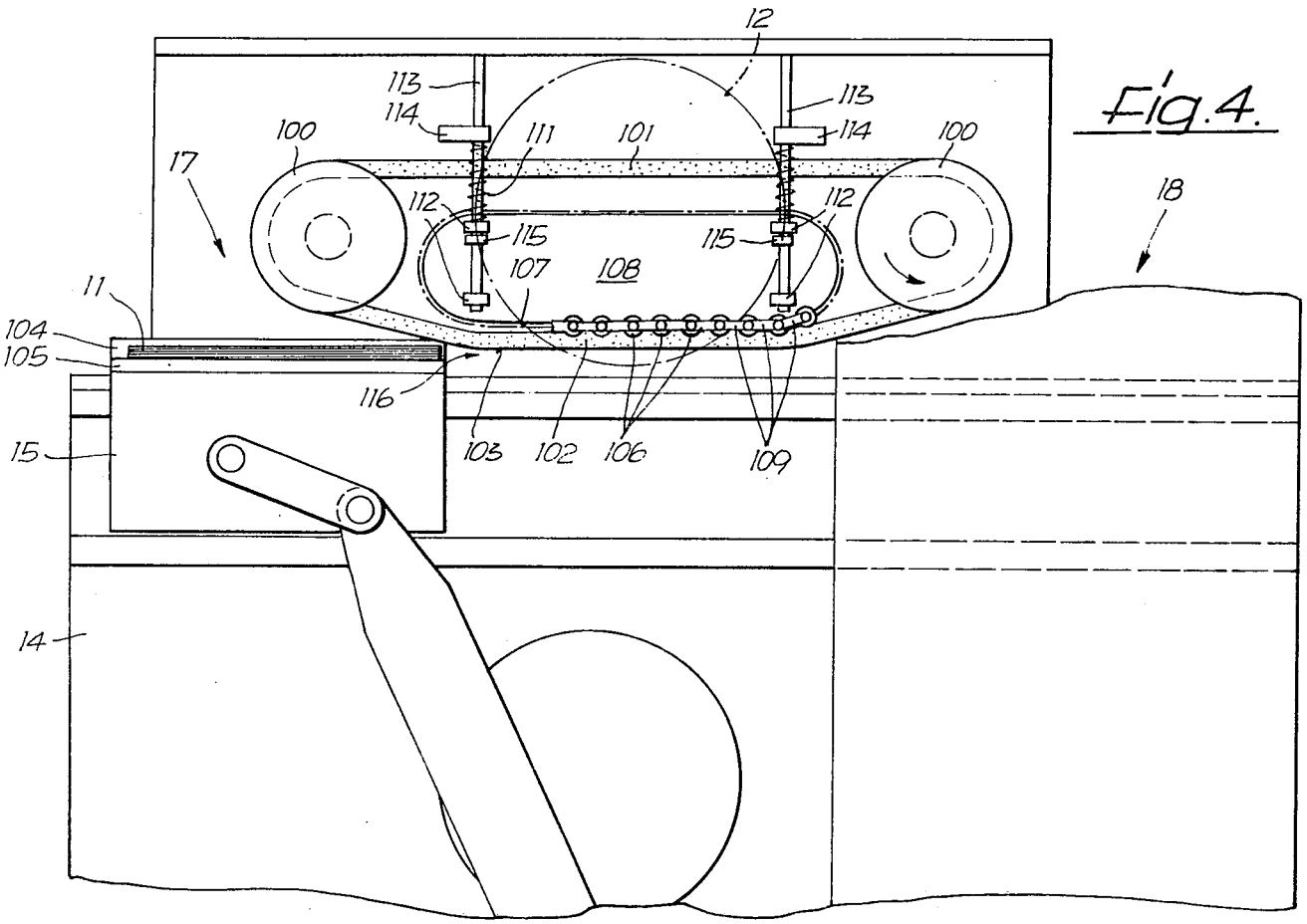
FIGS. 4 and 5 are simplified schematic views showing alternative embodiments of the clamping members of the invention.

In FIG. 4, a modified embodiment is schematically represented in a very simplified manner. All parts have been omitted which have previously been described in connection with the preceding embodiment of the invention in order to achieve a better functional clarity. In this embodiment of the invention, the clamping strip closest to the axis of rotation of the disk-knife 12 is formed by an endless V-belt 101 which is supported on two reversing wheels 100 mounted by non-illustrated bearings attached to the machine casing 14. The right-hand reversing wheel 100 in FIG. 4 is driven in the direction of the arrow over a free wheel clutch with a speed which is slightly lower than the maximum advance speed of the sliding carriage 15 during its advance stroke. The strand 102 of the V-belt 101 facing the sliding carriage 15 forms a clamping surface 103 which interacts with the clamping element carried by the sliding carriage 15. Thus, this clamping element is not designed as a small strip as in the preceding embodiment of the invention, but as a plate 105 which is wide enough to receive the entire pile to be cut. Instead of the stop 93 attached to the machine casing, in this case, a stop 104 is provided at the rear edge of the plate for piles of sheet to be supplied from a direction vertical to the plane of the drawing in FIG. 4.

In the cutting range of the disk-knife 12, the side of the strand 102 opposite the clamping surface 103 bears against rollers or roller elements 106 which, on their side opposite the strand 102, are arranged about a supporting track 107 formed by a support element 108 which is fabricated of a steel plate. At its periphery, each of the rollers 106 is provided with an annular groove complimentary to the V-belt profile and into which engages the inner edge of the endless V-belt 101 and an outer complimentary edge of the support element 108. The rollers 106 are connected by means of butt straps 109 to form an endless chain of rollers arranged about the entire periphery of the support element 108. In this way, the rollers 106 are properly and accurately guided by the edge of the support element 108. The support element 108 forms a member elongated in the horizontal direction with rounded ends and is vertically movably supported against the bias of springs 111. For this purpose, at each end of the support element 108 there are attached two arms 112 arranged one above the other and extending horizontally. The arms 112 have holes at their free ends for receiving two vertical guide bars 113 attached to the machine casing 114. The springs 111 are designed as compression springs for enclosing the guide bars 113 and are supported at their lower ends by respective upper arms 112 and at their upper ends by arms 114 attached to the machine casing 14 so that the support element 108 is urged downwardly until the upper arms 112 of the support element 108 are located against stops 115 rigidly connected to the guide bars 113. The stops 115 are adjustable along the guide bars 113 so that a desired clamping gap 116 spacing can be adjusted between the clamping surface 103 and the clamping plate 105.

In order to obtain different adjustments of the support element 108 with a proper guiding of the V-belt 101, the latter consists of an elastic tensible material. It may, however, be fabricated of a non-tensible material or could be reinforced with steel wires so as to be non-tensible. In such case, a spring-loaded tension roller must be provided for the upper strand of the V-belt 101 to permit a resilient downward shifting of that part of the lower strand of the V-belt which is supported by the rollers 106. In this instance, the springs 111 must be chosen in such a way that their force is greater than the force produced by the tension of the V-belt urging the support element 108 upwardly and, further, that it is sufficient, after having overcome the force produced by the V-belt, to produce the clamping pressure necessary to maintain the brochure 11 clamped during the cutting thereof with the disk-knife 12.

As soon as the sliding carriage 15 is at the receiving end 17, a pile 11 is ejected onto the carriage and is retained by the stop 104. During operation, the V-belt 101 is driven continuously at a speed which is only slightly lower than the maximum advance speed of the sliding carriage 15 during its advance stroke. As soon as the sliding carriage performs its advance stroke, the pile of sheets 11 is supplied to the disk-knife 12 while being clamped between the clamping surface 103 of V-belt 101 and the clamping plate 105 whereby the speed of V-belt 101 coincides with the speed of the sliding carriage owing to its drive over free wheel couplings. As soon as the sliding carriage 15 has reached the take-off end 18, the cut pile of sheets 11 is removed from the plate 105 by means of suitable apparatus. The subsequent return movement of the slide carriage 15 is not obstructed by the V-belt 101 since the V-belt is arranged at a slight distance from the plate 105.

Figure 5:
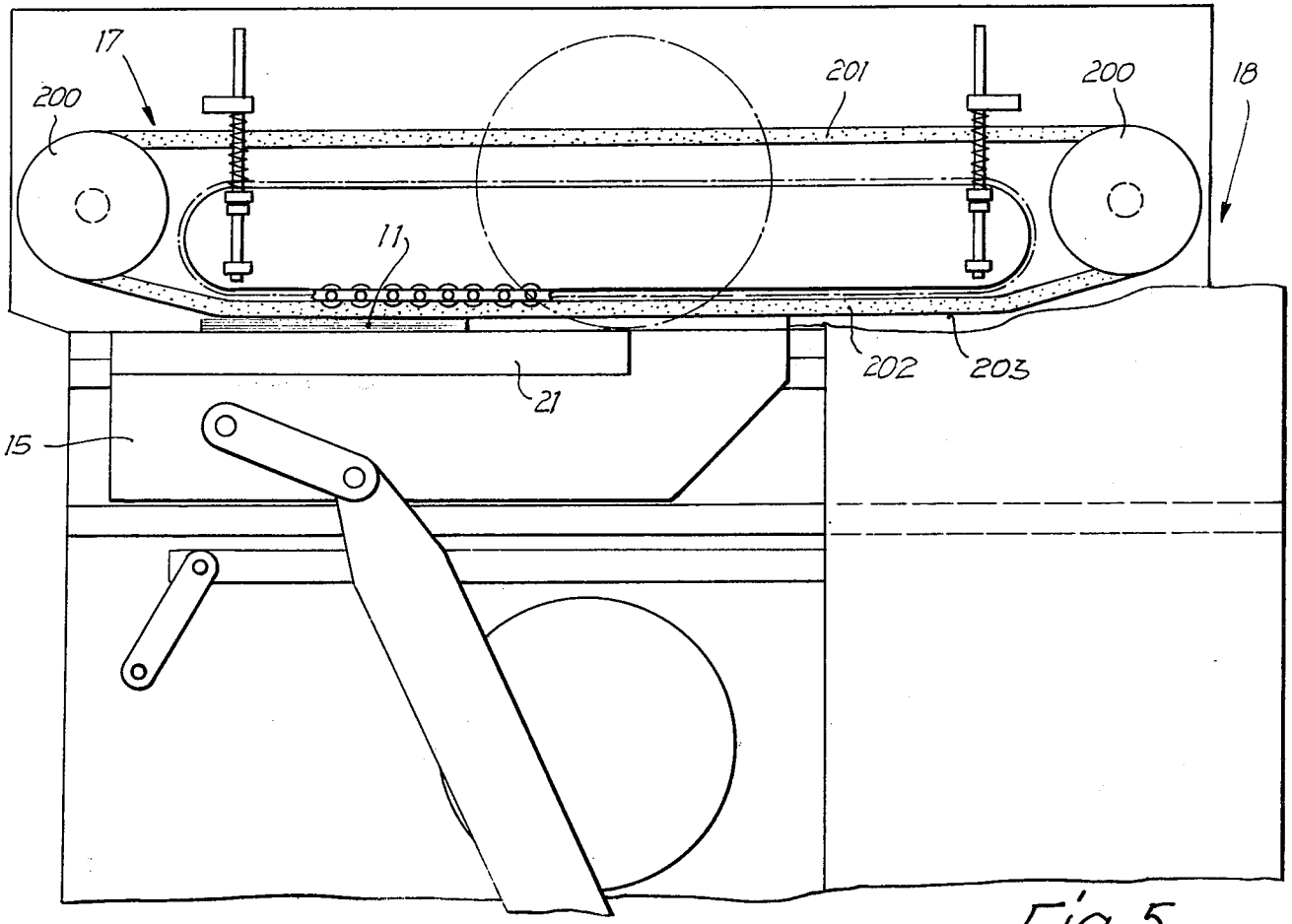

The alternate embodiment of the invention shown in FIG. 5, essentially differs from the embodiment according to FIG. 4 in that, in this instance, the clamping surface 203 of the lower strand 202 of the V-belt 201 extends over the entire advance stroke of the sliding carriage 15. In order to be in a position to supply piles of sheets to the receiving end 17 and to remove them from the take-off end 18, the reversing wheels 200 are supported in bearings which can be moved up and down similar to the clamping strip 24 of the embodiment of the invention according to FIGS. 1 and 2. With this embodiment, the sliding carriage can be constructed in the same way as with the embodiment according to FIGS. 1 and 2, i.e., as a small strip 21. Since, in this instance, the pile of sheets is already clamped down with the lowering of the V-belt 201, a support for the entire pile of sheets on a plate such as plate 105 which moves with the sliding carriage is unnecessary.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. Apparatus for cutting through a pile of sheets comprising a machine casing, a disk-knife rotatably mounted on said casing, the periphery of said disk-knife forming a circular cutting edge, conveying means for holding and supplying the pile of sheets to the disk-knife, said conveying means including a pair of confronting clamping members for clamping at least a portion of the pile of sheets therebetween, said clamping members being supported by a sliding carriage reciprocatingly movable relative to the machine casing and perpendicular to the rotational axis of the disk-knife in an advance stroke and a return stroke between a receiving end and a take-off end, a counter-knife supported by said one of said clamping members and forming a counter-cutting edge for the cutting edge of the disk-knife, said counter-cutting edge extending over the entire cutting range of the disk-knife and being arranged at a radial distance from the rotational axis of the disk-knife such that the cutting edges of the knives overlap only to an extent necessary to locate the cutting edges adjacent each other, the radius of the disk-knife being selected such that, for the thickest pile of sheets to be cut, a tangent line of the circular cutting edge of the disk-knife at the point of intersection of the disk-knife with the side of the pile sheets facing the disk-knife forms an angle with the plane of movement of the carriage of less than 30 degrees, the peripheral speed of the disk-knife being correlated to and slightly greater than the speed of the advance stroke of the carriage.

2. Apparatus according to claim 1, wherein said one of said clamping members comprises a clamping strip having a clamping surface, a supporting surface on said machine casing for supporting the unclamped portion of the pile of sheets, said clamping surface being aligned with said supporting surface.

3. Apparatus according to claim 1, including first means for reciprocatingly moving said disk-knife into a cutting position and a rest position and second means for reciprocatingly moving said sliding carriage, said first and second moving means being synchronized such that the disk-knife is moved into its cutting position substantially at the beginning of the advance stroke of the sliding carriage and into its rest position after the pile of sheets has been cut.

4. Apparatus according to claim 1, wherein the counter-knife is in overlapping relation with the disk-knife at the end of the return stroke and the beginning of the advance stroke, the counter-cutting edge of the counter-knife being spaced from the cutting edge of the disk-knife at such stroke position by reason of a fixed curvature of the counter-knife.

5. Apparatus according to claim 3, wherein said first moving means includes a cam element and a two-arm lever, one arm of which supports the disk-knife and the other arm of which engages said cam element.

6. Apparatus according to claim 5, wherein said second moving means include crank means for returning the sliding carriage at a greater acceleration than the acceleration of the advance stroke.

7. Apparatus according to claim 3, including third means for reciprocatingly moving one of said clamping members from a clamping position to a release position, said one clamping member being arranged closer to the rotational axis of the disk-knife than the other of said clamping members.

8. Apparatus according to claim 7, wherein said third moving means is interconnected with said first moving means.

9. Apparatus according to claim 5, including means for rotating said disk-knife, said rotating means including a drive shaft upon which said cam element is mounted and by which said cam element is driven.

10. Apparatus according to claim 6, wherein said crank means and said cam element are driven by a common drive motor.

11. Apparatus according to claim 7, wherein said one clamping member comprises a clamping strip.

12. Apparatus according to claim 1, wherein one of said clamping members is arranged closer to the rotational axis of the disk-knife than the other of said clamping members, said one clamping member being formed by an endless belt having a clamping surface confronting the other clamping member and including rollers arranged within the cutting range of said disk-knife on the surface of said belt opposite said clamping surface, said rollers being supported on a supporting track of a support element.

13. Apparatus according to claim 12, wherein said clamping surface of the endless belt extends over the entire advance stroke of the sliding carriage.

14. Apparatus according to claim 12, including means for reciprocatingly moving said endless belt from a clamping position to a release position.

15. Apparatus according to claim 12, wherein said clamping surface extends over the space between the receiving end and the take-off end.

* * * * *